US006237318B1

(12) United States Patent
Kahan

(10) Patent No.: US 6,237,318 B1
(45) Date of Patent: May 29, 2001

(54) U-SHAPED TUBULAR METAL FOR ROPE CHAINS

(75) Inventor: Marvin Kahan, Brooklyn, NY (US)

(73) Assignee: Charm Link, Inc., New York, NY (US)

( * ) Notice: Subject to any disclaimer, the term of this patent is extended or adjusted under 35 U.S.C. 154(b) by 0 days.

(21) Appl. No.: 09/484,723

(22) Filed: Jan. 18, 2000

(51) Int. Cl.[7] ..... B21L 5/02
(52) U.S. Cl. ..... 59/80; 59/35.1; 59/82
(58) Field of Search ..... 59/80, 35.1

(56) References Cited

U.S. PATENT DOCUMENTS

| | | | | |
|---|---|---|---|---|
| 4,651,517 | | 3/1987 | Benhamou et al. | 59/80 |
| 5,125,225 | | 6/1992 | Strobel | 59/80 |
| 5,129,220 | | 7/1992 | Strobel | 59/80 |
| 5,285,625 | * | 2/1994 | Ofrat et al. | 59/80 |
| 5,353,584 | | 10/1994 | Strobel et al. | 59/80 |
| 5,412,935 | * | 5/1995 | Rozenwasser | 59/80 |
| 5,452,572 | * | 9/1995 | Alvaro et al. | 59/80 |
| 5,531,065 | * | 7/1996 | Rozenwasser | 59/80 |
| 5,537,812 | | 7/1996 | Rosenwasser | 59/80 |
| 5,660,036 | * | 8/1997 | Rozenwasser | 59/80 |

* cited by examiner

*Primary Examiner*—David Jones
(74) *Attorney, Agent, or Firm*—Helfgott & Karas, PC.

(57) ABSTRACT

A rope chain formed by intertwining links of a U-shaped cross-section is disclosed, which links are formed from a wire having an interconnecting upper portion, a pair of substantially straight legs extending downwardly from the interconnecting portion, and a substantially open bottom portion or seam opposite said interconnecting portion. The substantially straight legs, results in a rope chain having a full-bodied appearance and a snugger interfit between intertwined chain links. The U-shaped configuration can produce a rope chain that uses less precious metal than if the cross-section of the wire were annular and the links themselves were of annular, toroidal configuration.

35 Claims, 3 Drawing Sheets

U-SHAPED TUBULAR METAL FOR ROPE CHAINS

FIELD OF THE INVENTION

The invention relates to the use of U-shaped wire in the formation of links for a jewelry rope chain, and more particularly to the use of a non-annular wire having an upper interconnecting portion, a pair of elongated legs and a substantially open bottom.

BACKGROUND OF THE INVENTION

Hollow chain links that are intertwined to form jewelry rope chains are usually formed by first extruding a flat sheet of material between an outer die and a metal former to create an elongated wire. The resultant wire is formed with an opening or a seam that will eventually allow for the passage of the metal former when exposed to an acid, as is known in the art. Such wire is then usually formed into a coil on a mandril and then cut into individual links. Because of the spiral configuration, one end of each link will be slightly offset from the other end of such link. Prior to use, such links are made planar. In doing so, however, the wire itself is also slightly squashed. However, the cross-section of such links are still generally of an annular, toroidal configuration and are generally referred to as annular.

Thus, such links are generally annular in profile and annular in cross-section. The cross-sectional surface area of a seamed link having an annular cross section will generally be defined as $\pi(r_2^2-r_1^2)$ minus the seam, where $r_2-r_1$ designates the thickness of the sheet of material used to form the wire and the link. When the seam is rather minimal, as is the case with most prior art chain links, the cross-sectional surface area will approach that of a seamless, annular cross-section hollow link, or $\pi(r_2^2-r_1^2)$. Seamless hollow links are, however, not favored in the art, as discussed in U.S. Pat. No. 4,651,517 to Benhamou et al. and U.S. Pat. No. 5,129,220 to Strobel, because a seam accelerates the dissolving of the metal former used to create the wire.

Significant advances in the jewelry rope chain art are defined by the look of the resultant product and the method of making the same. Hollow-link rope chains advanced the art over solid-link rope chains by producing a chain with a similar appearance at a fraction of the cost. A chain worn around a person's neck will usually be admired more for its appearance than its weight, and a lighter chain provided at a reduced price, having the appearance of a heavier chain provided at a much higher price, will always benefit the consumer. Consequently, great attention has been paid to the method of manufacturing and forming the links that are intertwined into rope chains, with improvements or enhancements in each link resulting in a rope chain that is, on the whole, improved or enhanced over the prior art.

In an effort to produce a rope chain that is an improvement over the prior art, the present inventor has devised a way to produce a full-bodied rope chain with a reduction in the amount of material used to form the links. The present inventor accomplishes such task by forming intertwinable links from a wire with a non-annular, U-shaped cross section having an interconnecting portion, a pair of substantially straight leg portions, and an enlarged seam portion, not known before in the art. The enlarged seam portion allows for even quicker dissolving of the metal former, and the U-shaped cross section, as compared with an annular cross section, provides a much snugger, more abutting fit between intertwinable links assembled into a rope chain. Also, as will be described in more detail below, the U-shaped cross section provides a reduction in the amount of precious metal used, providing a surface area that is below the $\pi(r_2^2-r_1^2)$ approached by an annular link with a minimal seam.

As noted above, link segments are, in general, squashed slightly after separation from an initial, unitary coil configuration to make them planar. Thus, while the initial formation of the wire cross-sectional configuration of one embodiment of the present invention has a semi-spherical interconnecting bight portion, the slight squashing will make the bight portion slightly into an oval shape, and will actually elongate the legs, so that the legs wind up even slightly longer than when initially formed. Thus, the U-shaped cross-sectional configuration will result in links that are squashed in cross-section. The elongated legs result in a rope chain having a full-body appearance, and also allow for a snugger fit between intertwined chain links assembled in a rope chain. The snugger fit realized by the U-shaped cross sectional wire will be recognized in the manner in which a straight side lies best again another straight surface side, which is absent from a rope chain formed from chain links having an annular, toroidal configuration, where only point contact is made between abutting annular, toroidal links. As the significant advance of the present invention is in the use of the straight legs, the interconnecting portion need not be arcuate, but could also be of other shapes including oval or the like.

In the case of annular, toroidal cross-sectional configured links, it is often desired to simulate the facets found on the outside of a solid rope chain. In solid rope chains, the facets are formed by actually cutting off a portion of the exterior surface of selected links. With hollow rope chain, such cutting would perforate the wall of the link.

Various methods have been suggested to simulate such facets on hollow rope chain. One method is suggested in U.S. Pat. No. 5,125,225, U.S. Pat. No. 5,129,220 and U.S. Pat. No. 5,353,584, all to Strobel. In those patents, it is suggested to flatten the links by incrementally pounding on the surface. Other methods have also been suggested.

In classical rope chain, both hollow and solid, these facets or simulated facets occur in the outer portion of the links which form the exterior surface of the rope chain when assembled. In the present invention, there also exists the interconnecting portion as the exterior of the rope chain when assembled. Simulated facets can then also be made on such interconnecting portions, just as in classical rope chain.

Thus, through the use of the U-shaped cross-section for the links forming a rope chain, the present inventor still gets the interconnecting portion forming the exterior as in classical rope chain, but also gets a snugger fitting construction because of the elongated straight legs, and less precious metal because of the reduced cross-sectional area.

OBJECTS OF THE INVENTION

It is an object of the present invention, therefore, to provide a wire used in the formation of rope chain links having a U-shaped cross-section.

It is another object of the present invention to provide a wire used in the formation of rope chain links having an interconnecting portion, substantially straight legs extending downwardly therefrom, and a substantially open bottom portion opposite the interconnecting portion.

It is a still another object of at least some embodiments of the present invention to provide a wire used in the formation of rope chain links having a U-shaped cross-section that results in a rope chain formed from less precious metal than if the wire were annular in cross-section.

It is a still another object of at least some embodiments of the present invention to provide a wire used in the formation of rope chain links having a U-shaped cross-section with an enlarged seam portion that results in a rope chain formed from less precious metal than if the wire were annular in cross-section.

Still other objects and advantages of the invention will become clear upon review of the following detailed description in conjunction with the appended drawings.

SUMMARY OF THE INVENTION

A wire having a U-shaped cross-section for use in making links which are assembled into rope chain. The wire has an upper interconnecting portion, a pair of substantially straight legs extending downwardly from the interconnecting portion, and a substantially open bottom portion opposite said interconnecting portion. In one embodiment, the interconnecting portion and the upper portion of the legs at the junction of the legs with the interconnecting portion trace a consistent radius. However, the wire having a U-shaped cross-section of the present invention diverges from that of a wire having an annular cross-section along the lower portion of the cross section, where the lower segments of the wire of the present invention are substantially straight, and not curved inwardly like with a wire having an annular cross-section. Other interconnecting portion configurations could also be used, including oval and the like. The configuration of the chain will be a more full-bodied appearance and a snug interfit between intertwined chain links. Additionally, the substantially open bottom or seam portion, combined with the substantially straight legs, can result in the formation of a rope chain that uses less precious metal than if the cross-section of the wire were completely annular and the links themselves were of annular, toroidal configuration.

DETAILED DESCRIPTION OF THE PREFERRED EMBODIMENTS

Figure 1:
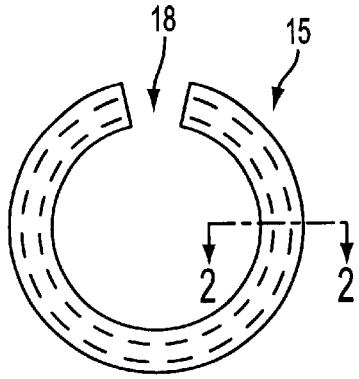
FIG. 1 (PRIOR ART)
FIG. 1 is a front view of a prior art link of an annular, toroidal configuration.

The focus of the present invention is on a unique U-shaped cross-sectional wire used in the formation of rope chain links, that results in a full-bodied rope chain having a snugger fit between links, yet which is also made from less precious metal than similar rope chains formed from links having annular, toroidal configurations. The reduction in material used translates into a remarkably lightweight chain.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

Figure 2:
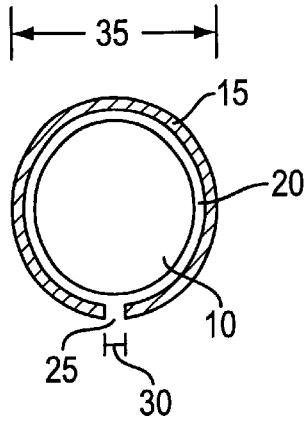
FIG. 2 (PRIOR ART)
FIG. 2 is a cross-sectional view taken along line 2—2 of FIG. 1, showing an annular wire formed on an annular metal former support.

FIG. 1 is a front view and FIG. 2 is a cross sectional view of a prior art hollow link 15 of an annular, toroidal configuration having a gap 18 for interconnecting with other links to form a rope chain and a wire thickness 20, with such wire wrapped around a metal former support 10 as is known in the art with the construction of hollow rope chain links. Both the link 15 and the former support 10 are annular in cross section. The link 15 is also provided with a seam 25 having a width dimension 30, which seam 25 allows for the dissolving of the former support 10 therethrough, and an outer diameter 35, which is consistent throughout the annular wire.

Figure 3:
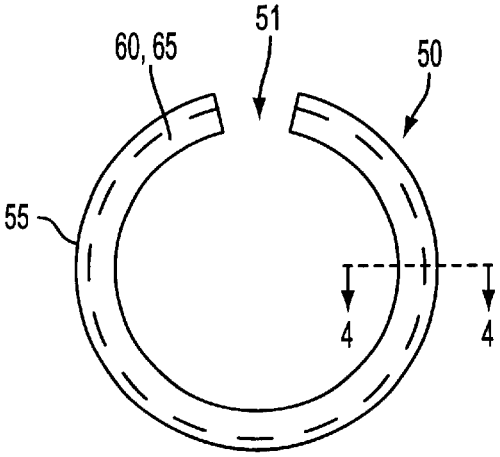
FIG. 3 is a front view of a link of the present invention having a U-shaped cross-sectional configuration.
Figure 4:
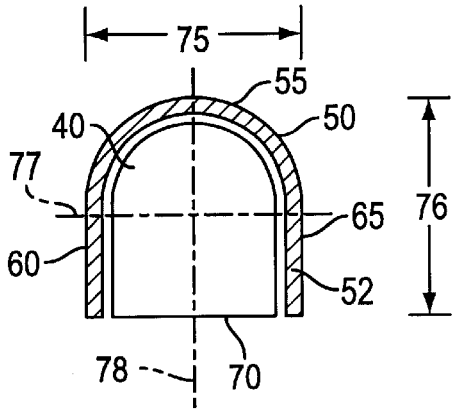
FIG. 4 is a cross-sectional view taken along line 4—4 of FIG. 3, showing the U-shaped wire of the present invention formed on a bullet-shaped metal former.

FIG. 3 is a front view and FIG. 4 is a cross-sectional view of an annular link 50 having a non-annular, U-shaped cross-section in accordance with the present invention and situated around a bullet-shaped metal former 40. The link 50 has a gap 51 for interconnecting with other links to form a rope chain. In cross section, the wire has a thickness 52, an interconnecting portion 55, a pair of substantially straight and parallel leg portions 60,65 extending downwardly from said interconnecting portion 55, and a substantially open bottom portion 70 opposite said interconnecting portion 55. The interconnecting portion also has a diameter 75, which is also the distance between the substantially straight leg portion 60,65 along the transverse axis 77 of the link 50. The value of the diameter 75, or the distance between the legs 60 and 65, is also approximately equal to the distance 76 between the top of the interconnecting portion 55 and the distal ends of the legs 60,65 along the longitudinal axis 78 of the link 50.

Figure 5:
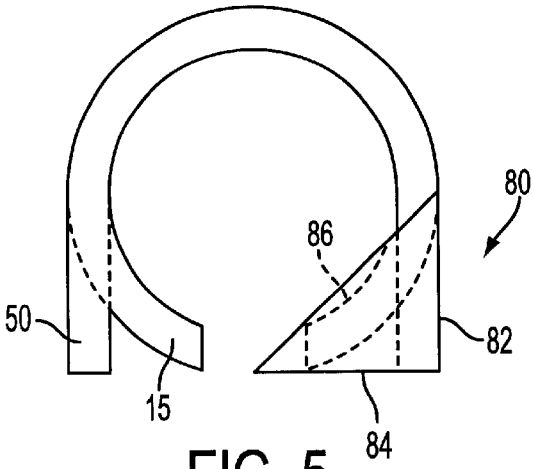
FIG. 5 is a juxtaposition of FIGS. 2 and 4 for purposes of illustrating the material benefits of using the U-shaped wire of the present invention over the annular wire of the prior art.

FIG. 5 is a juxtaposition of the cross-sections of the links of FIGS. 2 and 4, showing the cross-sectional differences between the U-shaped cross-section link 50 of the present invention over the annular, toroidal cross-section link 15 of the prior art. The upper or interconnecting portions of both link cross-sections appear identical to illustrate the distinctions between the bottom, seam portions. However, the sides are substantially different. In the present invention, the legs 60,65 (see FIG. 4) are substantially straight and parallel. This results in an enlarged seam portion 70 (see FIG. 4), which is substantially open as compared with the minimal seam portion 25 (see FIG. 2) of the prior art annular, toroidal link. The enlarged seam portion 70 and substantially straight legs 60,65 (see FIG. 4) results in a link that uses less precious metal as compared with an annular link. The amount of precious metal saved by using a U-shaped wire as compared with an annular wire can be described by superimposing a right triangle 80 onto one corner of the juxtaposed cross-section wires of FIG. 3. The right triangle 80 has one side 82, a second side 84, and a hypotenuse side 86. The side 82 most closely represents the portion attributed to the U-shaped wire 50 of the present invention, while the side 86 most closely represents the portion attributed to the annular wire 15 of the prior art. As is well known, the hypotenuse of a triangle is longer than each of the sides. Consequently, the U-shaped wire uses less of the precious metal as is used by the annular wire along each lower portion of the cross-section, resulting in a savings of material along each lower portion. Since FIGS. 2 and 4 are cross-sections, this savings in material is multiplied along the entire length of the wire, which is formed into links and finally into a jewelry rope chain of remarkable lightness.

Figure 6:
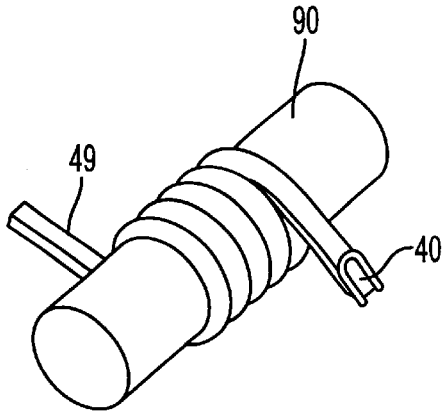
FIG. 6 is an isometric view of a U-shaped cross-sectional wire wrapped around a mandril.

FIG. 6 is an isometric view of a U-shaped wire 49 of the present invention wrapped around a support mandril 90 in preparation for segmenting into chain links 50 (see FIGS. 3 and 4), as is known in the art. The hollow wire 49 is preferably wrapped with the metal former 40 intact, to prevent deformation of the wire during the segmenting of the wire into links and the intertwining of links into rope chains and the like. Other methods of segmenting the wire into links are well known and can also be used.

During manipulating and cutting, it may occur that the wire 49 may tend to spring off the metal former support 40. Therefore, it may be desirable to provide some retaining means on the U-shaped configuration to hold on to the interior metal former 40. This can either be little gripping extensions 72,74 formed at the distal end of the legs 60,65 (see FIGS. 7 and 8), or other retaining means could be used. The gripping extensions are preferably small tabs extending from the distal ends of the straight legs that wrap around to retain a grip on the metal former support 40.

Figure 8:
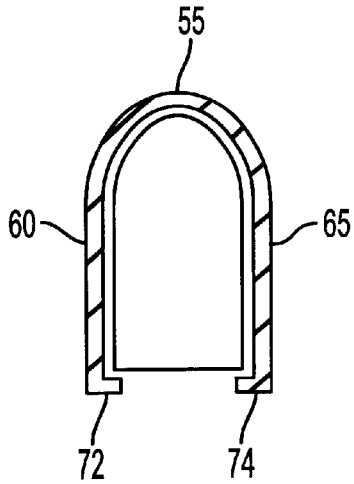
FIG. 8 is a cross-sectional view taken along line 8—8 of FIG. 7, showing a U-shaped wire of the present invention formed on a bullet-shaped metal former with an ovate upper, interconnecting portion and gripping extensions for holding the metal former.
Figure 9:
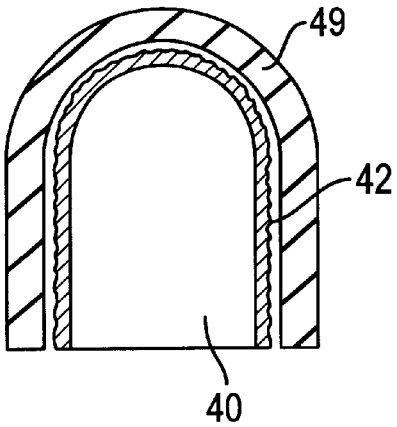
FIG. 9 is a cross-sectional view of a U-shaped wire of the present invention extended around an adhesive-laden metal former.
Figure 10:
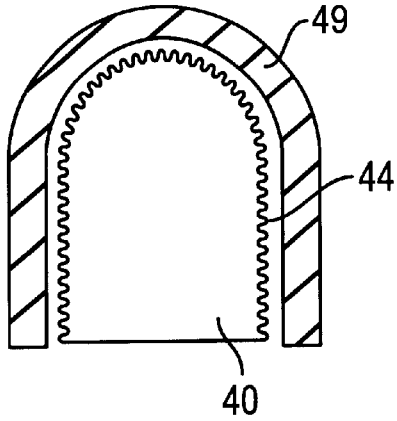
FIG. 10 is a cross-sectional view of a U-shaped wire of the present invention extended around a metal former having a textured surface.

Other methods could be used. For example, as shown in FIG. 9, the metal former 40 could have an adhesive layer 42 along the contact surface with the U-shaped cross-sectional wire 49, or as shown in FIG. 10, the outer surface 44 could be roughened to increase the frictional grip of the U-shaped wire 49 on the metal former 40. In both situations illustrated in FIGS. 9 and 10, the adhesive layer 42 and the textured surface 44 could either be present on the metal former 40 or the wire 49, or both, and in both situations the gripping tips 72,74 (see FIGS. 7 and 8) would not be necessary. Of course, other retaining means sufficient to maintain contact between the metal former 40 and the U-shaped wire 49 during coiling on a mandril, segmenting into links and intertwining into a jewelry rope chain may be used as desired if necessary. However, in many instances the grip of the "U" shape on the former support may itself be sufficient.

Figure 7:
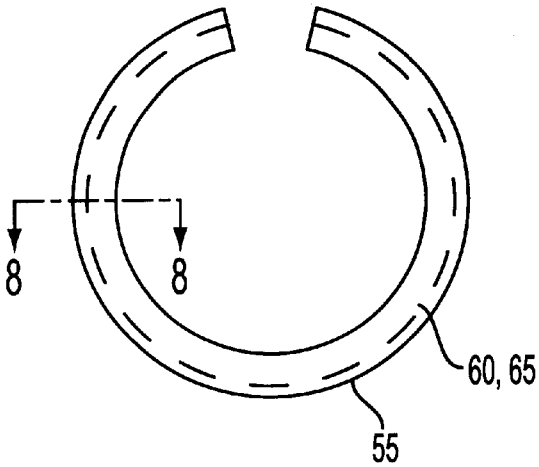
FIG. 7 is a front view of a link in accordance with yet another embodiment of the present invention having a U-shaped cross-sectional configuration.

Returning now to FIG. 6. As is known in the art, once a wire is wrapped around a supporting mandril, such wire is segmented and slightly squashed into planar links for intertwining into rope chains. Since the U-shaped hollow wire of the present invention has a substantially open bottom portion and substantially straight and parallel side legs, the flattening or slightly squashing of the segmented links tends to, as shown in FIGS. 7 and 8, elongate the sides 60,65 and cause the interconnecting portion 55 to become slightly more ovate than semi-circular as originally formed (see FIG. 4), and even more so than as compared with an annular prior art link of FIGS. 1 and 2.

Figure 11:
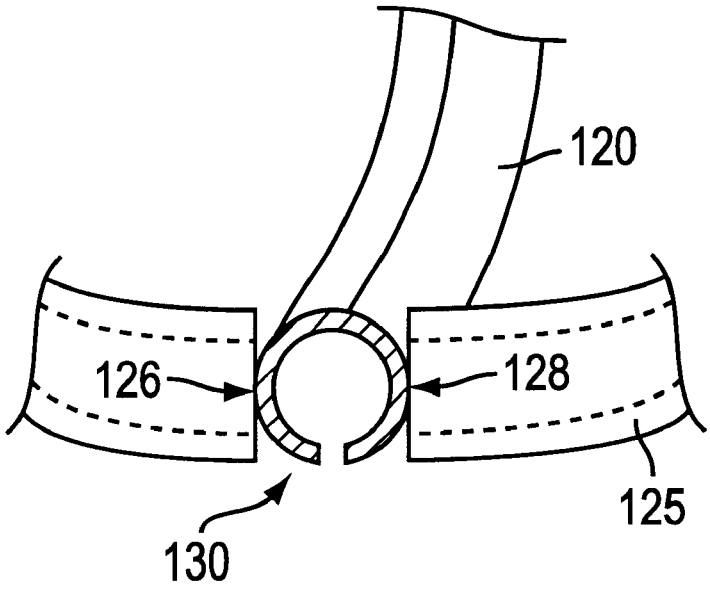
FIG. 11 is a diagrammatic view of a pair of intertwined links of an annular, toroidal cross-sectional configuration, for purposes of illustrating the point contact of the links along the gap wall.

FIG. 11 is a diagrammatic view of a pair of intertwined links 120 and 125 having an annular, toroidal cross-sectional configuration, similar to the prior art links described previously in FIGS. 1 and 2, with the link 120 being intertwined through the gap 130 in link 125. Annular, toroidal links are, by their very rounded nature, only capable of point contact with a flat gap wall, particularly when intertwined in a rope chain format. The two point contacts are illustrated by arrows 126 and 128, which results in a loose interfit between intertwined links and a loosely constructed rope chain.

Figure 12:
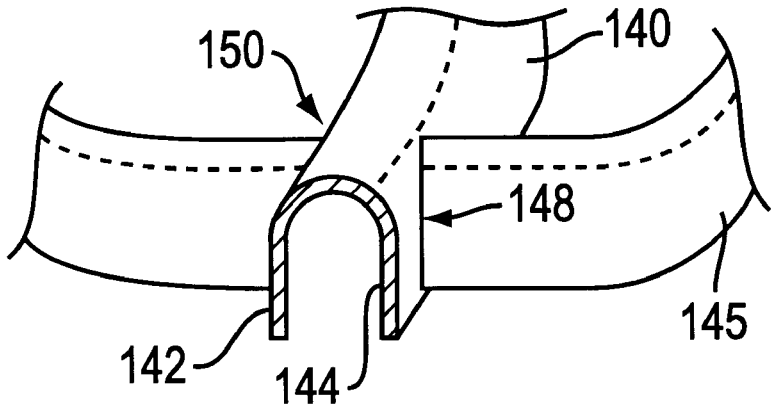
FIG. 12 is a diagrammatic view of a pair of intertwined links of a U-shaped cross-section of the present invention for purposes of illustrating the full surface contact of the links along the gap wall.

By using the U-shaped configuration of the present invention, on the other hand, the deficiency of the prior art point contact is remedied by a flat surface contact, resulting in a much tighter, cleaner fit between intertwined links and a more full-bodied appearance overall. FIG. 12 is a diagrammatic view of a pair of intertwined links 140 and 145 of U-shaped cross-section, similar to the links 50 described previously in FIGS. 3 and 4, with the link 140 being intertwined through the gap 150 in link 145. When the links 140 and 145 of the present invention are intertwined to form a rope chain, the substantially straight, elongated side legs 142,144 of adjacently lying links lie flat against each other, resulting in a rope chain that has a much snugger fit and a much more full-bodied appearance than what is normally produced with annular, toroidal links. An example of the surface contact along the flat gap wall is illustrated along surface 148, which is significantly greater than the annular, toroidal point contacts 126,128 of FIG. 11.

What has unexpectedly been found is the large seam can be used and still produce a superior chain. If a larger seam were used with links having an annular, toroidal cross-sectional configuration, the lower half of the annular, toroidal cross-section would be removed. The height of the cross-section would then be much less than the width. The chain would thus be loose, and lack aesthetic acceptability. However, because of the elongated, straight legs of the present invention which extend down to provide a height substantially equal to or greater than the width, even with a seam that spans the entire distance between the legs, not only is the chain aesthetically acceptable, but even superior in appearance.

Figure 13:
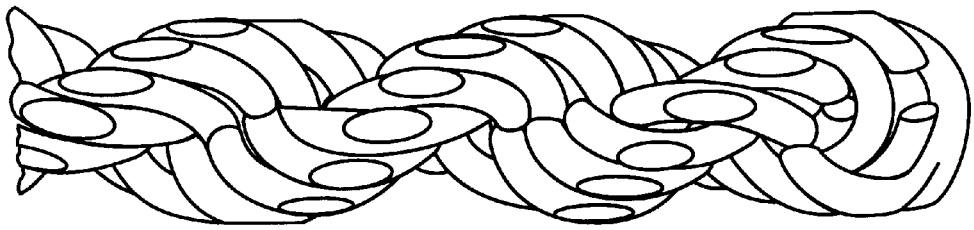
FIG. 13 is a rope chain formed from the U-shaped wire of the present invention and showing simulated facets formed on the arcuate interconnecting bight portions of the exterior of the links forming the outside surface of the chain.

Once a rope chain is formed using the U-shaped wire of the present invention, it can then be either left as an original chain, or it can be faceted to form polished surfaces as shown in FIG. 13. FIG. 13 shows simulated facets formed on the interconnecting portions of the exterior of the links forming the outside surface of the chain. Such faceting can be of any well-known methods, including those taught by Strobel, by flattening and others. Also, depending on the type of material used for the metal former, such former will be dissolved either before or after the individual links have been arranged and soldered in a rope chain format. Usually, if the metal former is made from aluminum, it will be dissolved before soldering, while if the metal former is made from iron, it will be dissolved after soldering.

Because of the above mentioned benefits of using the U-shaped wire of the present invention, the present invention is able to use less sheet material during the initial extrusion process to produce the full-bodied rope chain of remarkable lightness. Referring back to the comparisons between FIGS. 2 and 4, the same sheet of material, i.e. the same width and thickness, was used to produce an annular wire link of FIG. 2 and a U-shaped wire link of FIG. 4. The present inventor has found, however, that he is able to decrease the width of the sheet of precious metal used to form the U-shaped wire by 15%, for example, and produce an even more improved rope chain than with an annular cross-section in that this chain is a full-bodied rope chain, due to the straight leg portions. Thus, the present inventor is able to save material due to the U-shaped cross-section of the wire used, and obtain an improved appearance of the rope chain that is ultimately formed from such wire.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A chain link for intertwining with other chain links to form a jewelry rope chain, said link having a substantially U-shaped cross-section of substantially uniform thickness throughout said link comprising:

a) an upper interconnecting portion, b) a pair of substantially elongate and substantially parallel legs extending downwardly from said interconnecting portion, and c) a substantially open bottom portion opposite said upper interconnecting portion.

2. A chain link in accordance with claim 1, wherein said legs are substantially straight.

3. A chain link in accordance with claim 1, wherein said upper interconnecting portion is arcuate.

4. A chain link in accordance with claim 1, wherein said upper interconnecting portion is oval.

5. A chain link in accordance with claim 1, wherein said link cross section further comprises a surface area defined by a value that is less than a value of a surface area of a unit chain link of annular cross-section having a diameter equal to the width of said substantially straight and parallel legs.

6. A chain link in accordance with claim 1, further comprising retaining means for retaining said chain link on a supporting former during the intertwining of said links into a rope chain.

7. A chain link in accordance with claim 6, wherein said retaining means further comprises a pair of gripping portions disposed at the distal ends of said legs.

8. A chain link in accordance with claim 6, wherein said retaining means further comprises an adhesive layer along one of said chain link and said supporting former.

9. A chain link in accordance with claim 6, wherein said retaining means further comprises a textured surface along one of said chain link and said supporting former.

10. A chain link in accordance with claim 1, wherein the height from the top of the interconnecting portion to the distal ends of said legs proximates the width from leg to leg.

11. A chain link in accordance with claim 1, wherein the height from the top of the interconnecting portion to the distal ends of said legs is at least as long as the width from leg to leg.

12. A jewelry rope chain comprised of intertwinable chain links, each of said chain links having a substantially U-shaped cross-section of substantially uniform thickness throughout the link comprising:

a) an upper interconnecting portion, b) a pair of substantially elongate and substantially parallel legs extending downwardly from said interconnecting portion, and c) a substantially open bottom portion opposite said interconnecting portion.

13. A jewelry rope chain in accordance with claim 12, wherein said legs are substantially straight.

14. A jewelry rope chain in accordance with claim 12, wherein said upper interconnecting portion is arcuate.

15. A jewelry rope chain in accordance with claim 12, wherein said upper interconnecting portion is oval.

16. A jewelry rope chain in accordance with claim 12, wherein the cross section of each of said chain links comprises a surface area defined by a value that is less than a value of a surface area of a corresponding unit chain link of annular cross-section having a diameter equal to the width of said substantially straight and parallel legs.

17. A jewelry rope chain in accordance with claim 12, further comprising retaining means for retaining said chain link on a supporting former during the intertwining of said links into a rope chain.

18. A jewelry rope chain in accordance with claim 17, wherein said retaining means further comprises a pair of gripping portions disposed at the distal ends of said legs.

19. A jewelry rope chain in accordance with claim 17, wherein said retaining means further comprises an adhesive layer along one of said chain link and said supporting former.

20. A jewelry rope chain in accordance with claim 17, wherein said retaining means further comprises a textured surface along one of said chain link and said supporting former.

21. A jewelry rope chain in accordance with claim 12, wherein the height from the top of the interconnecting portion to the distal ends of said legs proximates the width from leg to leg.

22. A jewelry rope chain in accordance with claim 12, wherein said rope chain is faceted.

23. A jewelry rope chain in accordance with claim 22, wherein said rope chain is faceted by flattening the exterior surfaces of said chain links.

24. A jewelry rope chain in accordance with claim 12, wherein the height from the top of the interconnecting portion to the distal ends of said legs is at least as long as the width from leg to leg.

25. A substantially U-shaped wire for the formation of chain links that are intertwinable with other chain links to form a jewelry rope chain, said wire having a cross-section of substantially uniform thickness comprising:

a) an upper interconnecting portion, b) a pair of substantially elongate and substantially parallel legs extending downwardly from said interconnecting portion, and c) a substantially open bottom portion opposite said interconnecting portion.

26. A substantially U-shaped wire in accordance with claim 25, wherein said legs are substantially straight.

27. A substantially U-shaped wire in accordance with claim 25, wherein said upper interconnecting portion is arcuate.

28. A substantially U-shaped wire in accordance with claim 25, wherein said upper interconnecting portion is oval.

29. A substantially U-shaped wire in accordance with claim 25, wherein said wire cross section further comprises a surface area defined by a value that is less than a value of a surface area of a unit wire of annular cross-section having a diameter equal to the width of said substantially straight and parallel legs.

30. A substantially U-shaped wire in accordance with claim 25, further comprising retaining means for retaining said chain link on a supporting former during the intertwining of said links into a rope chain.

31. A substantially U-shaped wire in accordance with claim 30, wherein said retaining means further comprises a pair of gripping portions disposed at the distal ends of said legs.

32. A substantially U-shaped wire in accordance with claim 30, wherein said retaining means further comprises an adhesive layer along one of said chain link and said supporting former.

33. A substantially U-shaped wire in accordance with claim 30, wherein said retaining means further comprises a textured surface along one of said chain link and said supporting former.

34. A substantially U-shaped wire in accordance with claim 25, wherein the height from the top of the interconnecting portion to the distal ends of said legs proximates the width from leg to leg.

35. A substantially U-shaped wire in accordance with claim 25, wherein the height from the top of the interconnecting portion to the distal ends of said legs is at least as long as the width from leg to leg.

* * * * *